United States Patent [19]

Whiteley

[11] Patent Number: 4,969,524

[45] Date of Patent: Nov. 13, 1990

[54] WELL COMPLETION ASSEMBLY

[75] Inventor: Thomas G. Whiteley, Houston, Tex.

[73] Assignee: Halliburton Company, Duncan, Okla.

[21] Appl. No.: 422,849

[22] Filed: Oct. 17, 1989

[51] Int. Cl.[5] ..... E21B 43/04

[52] U.S. Cl. ..... 166/278; 166/51; 166/205; 166/317; 166/318; 166/332

[58] Field of Search ..... 166/278, 276, 51, 205, 166/317, 318, 320, 332

[56] References Cited

U.S. PATENT DOCUMENTS

| | | | |
|---|---|---|---|
| 2,224,538 | 12/1940 | Eckel et al. | 166/278 |
| 2,299,057 | 10/1942 | McClain | 166/51 |
| 2,978,027 | 4/1961 | Widmyer | 166/51 |
| 3,074,486 | 1/1963 | Murray, Jr. | 166/317 X |
| 3,913,675 | 10/1975 | Smyrl | 166/278 |
| 4,018,284 | 4/1977 | Perkins | 166/51 X |
| 4,105,069 | 8/1978 | Baker | 166/51 |
| 4,270,610 | 6/1981 | Barrington | 166/317 |
| 4,512,406 | 4/1985 | Vann et al. | 166/297 |
| 4,566,478 | 1/1986 | Deaton | 166/332 X |
| 4,635,716 | 1/1987 | Zunkel | 166/51 |
| 4,638,859 | 1/1987 | Zunkel et al. | 166/51 |
| 4,662,447 | 5/1987 | Bolin | 166/278 |
| 4,700,777 | 10/1987 | Luers | 166/51 X |
| 4,856,590 | 8/1989 | Caillier | 166/278 |

OTHER PUBLICATIONS

Exhibit A–Brochure entitled "Vann Systems Technical Data–Bar Pressure Vent [BPV]" of Vann Systems, Houston, TX.

Exhibit B–Drawing of Typical Prior Art Overshot.

Exhibit C–Sketch of Typical Prior Art Squeeze Gravel Pack Tool Assembly.

Exhibit D–Drawing of Hydraulic Release Utilized with Prior Art Structure of Exhibit C.

Exhibit E–Drawing of a Portion of the Tool String of Exhibit C Utilizing a Clutch Joint Instead of a Hydraulic Release.

*Primary Examiner*—Hoang C. Dang

*Attorney, Agent, or Firm*—James R. Duzan; L. Wayne Beavers

[57] ABSTRACT

A well completion assembly is constructed to be run on a tubing string into a well. The well can be gravel packed and subsequently opened to production without removing the tubing string from the well. The well completion assembly includes a packer, and a screen located below the packer. A gravel packing and production control assembly is located between the packer and the screen for initially permitting flow of gravel packing slurry down the tubing string and into a lower well annulus surrounding the exterior of the screen, and for subsequently permitting production of well fluids through the screen into the interior thereof and up through the tubing string without tripping the tubing string out of the well.

13 Claims, 3 Drawing Sheets

WELL COMPLETION ASSEMBLY

BACKGROUND OF THE INVENTION

1. Field Of The Invention

The present invention relates generally to systems for gravel packing wells, and more particularly, but not by way of limitation, to a one trip gravel packing system which can perform a squeeze pack on a well, and can subsequently produce well fluids without tripping the gravel packing system and the tubing string to which it is attached out of the well.

2. Description Of The Prior Art

In a typical gravel packing operation, the gravel packing assembly is run into the well on a work string. The appropriate zone or zones of the well are gravel packed, and then the work string and some portion of the gravel packing apparatus are removed from the well. Subsequently, a production tubing string with associated apparatus is lowered into the well and engaged with that portion of the gravel packing apparatus which was left in the well.

This tripping of the initial work string out of the well and tripping of the production string back into the well is a time consuming and expensive operation, particularly with relatively deep wells where it may take on the order of eighteen hours of rig time.

SUMMARY OF THE INVENTION

The present invention provides a well completion system which can be utilized to gravel pack a well, and subsequently permit production from the well without ever removing the work string associated with the gravel packing operation from the well.

The well completion assembly is constructed to be run on a tubing string into a well having a well bore. The assembly includes a packer for sealing between the tubing string and the well bore to define a lower well annulus below the packer. A screen assembly is located below the packer and has an interior and an exterior.

A gravel packing and production control means is located between the packer and the screen for initially permitting flow of gravel packing slurry down the tubing string and into the lower well annulus around the exterior of the screen. The control means subsequently permits production of well fluids through the screen into the interior thereof and up through the tubing string without tripping the tubing string out of the well.

The gravel packing and production control means includes a cylindrical body having a side wall with a gravel packing port disposed therethrough. The body has an upper end and a lower end, and has a longitudinal passageway defined therethrough from the upper end to the lower end. The longitudinal passageway intersects the gravel packing port.

The gravel packing and production control means also includes a valve means disposed in the body for initially blocking the longitudinal passageway below the gravel packing port while the gravel packing port is communicated with the longitudinal passageway. The valve means subsequently isolates the gravel packing port from the longitudinal passageway and opens the longitudinal passageway to permit production of well fluids therethrough.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
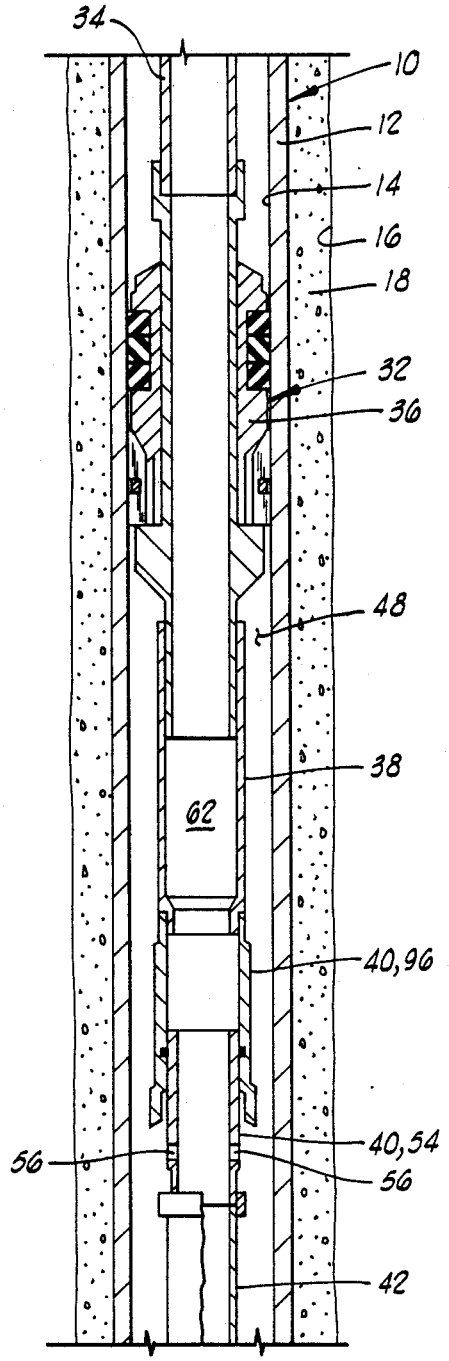
FIGS. 1A–1B comprise an elevation section schematic view of the well completion assembly of the present invention in place in a well. In the view of FIGS. 1A–1B, the gravel packing operation has been completed and the well is open to production.
Figure 1B:
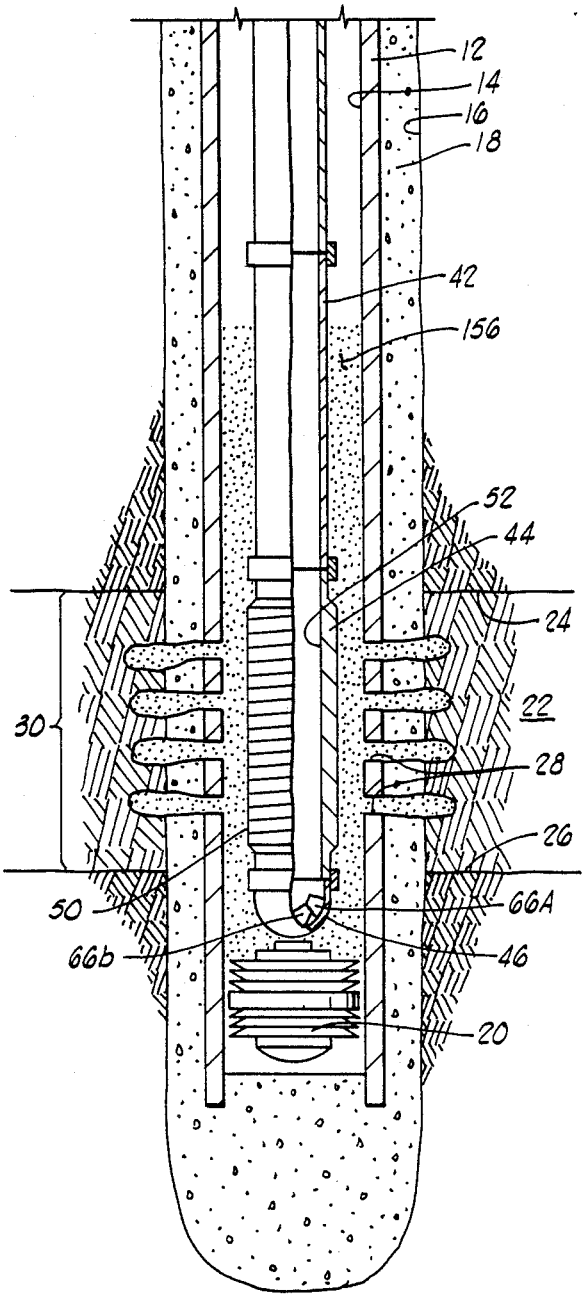

Referring now to the drawings, and particularly to FIGS. 1A–1B, a well is shown and generally designated by the numeral 10. The well 10 is defined by a casing 12 having a casing bore or well bore 14. The casing 12 is received within a bore hole 16 and cemented in place therein by cement indicated at 18.

As seen in FIG. 1B, a lower end of the well 10 is closed by a sump packer 20.

The well 10 intersects a subsurface formation 22 having upper and lower boundaries 24 and 26. A plurality of perforations such as 28 have been formed through the well casing 12 and cement 16 and into the subsurface formation 22 to define a perforated zone 30 of the well 10.

A well completion assembly generally designated by the numeral 32 is constructed to be run into the well 10 on a tubing string 34. The well completion assembly 32 includes a packer means 36, a slip joint 38, a gravel packing and production control means 40, a blank pipe section 42, a screen 44 and a bull plug 46.

The packer means 36 provides a means for sealing between the tubing string 34 and the well bore 14 to define a lower well annulus 48 below the packer means 36.

The slip joint 38 is included in order to accommodate movement of the tubing string 34 after the gravel packing operation is completed so that surface production equipment such as a Christmas tree (not shown) can be connected to the tubing string 34. The well completion assembly can be run without slip joint 38, but its use is preferred.

The gravel packing and production control means 40 provides a means for initially permitting flow of gravel packing slurry down the tubing string 34 and into the lower well annulus 48 around the exterior of screen 44, and for subsequently permitting production of well fluids through the screen 44 and up through the tubing string 34 without tripping the tubing string 34 out of the well. The details of construction of the gravel packing and production control means 40 are described below with reference to FIGS. 2 and 3.

The blank pipe section 42 is provided to space the screen 44 an appropriate distance below the packer 36.

The screen 44 is a cylindrical screen having an exterior 50 exposed to the perforated zone 30 of well 10, with the screen having a multiplicity of openings therethrough communicating the exterior 50 with an interior 52 of screen 44. The bull plug 46 closes off the lower end of screen 44.

Figure 2:
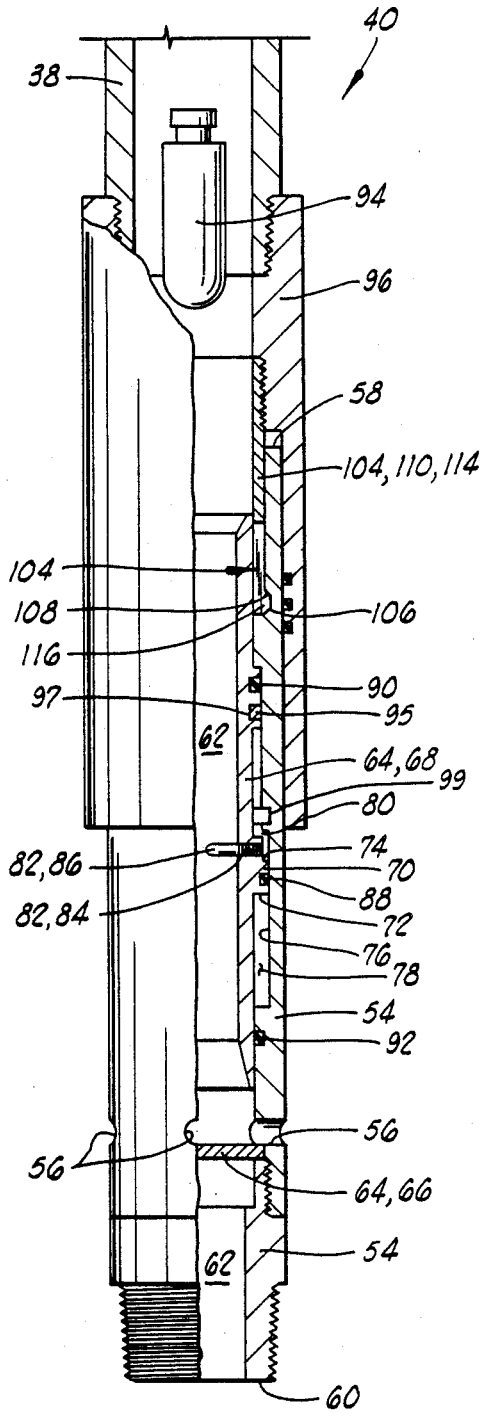
FIG. 2 is an elevation half section partially schematic illustration of the gravel packing and production control means of the well completion assembly. The gravel packing and production control means is shown in FIG. 2 in a first position wherein the longitudinal passageway therethrough is blocked below the gravel packing ports and the gravel packing ports are open so that gravel packing slurry may be pumped therethrough.
Figure 3:
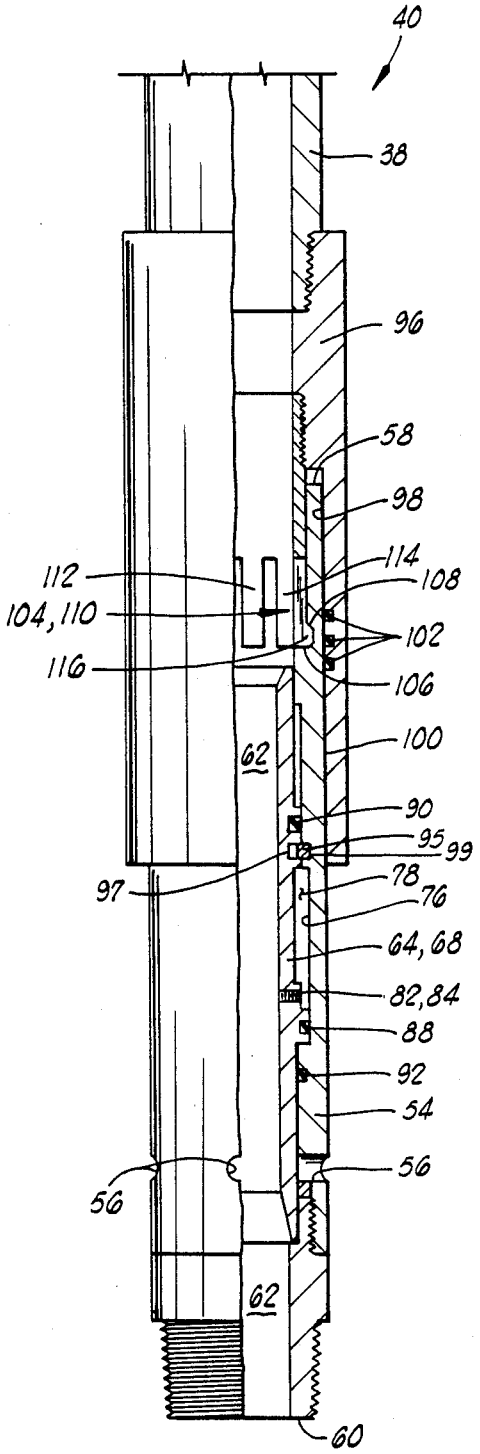
FIG. 3 is a view similar to FIG. 2 showing the gravel packing and production control means in a second position thereof wherein the gravel packing ports have been closed and the longitudinal passageway through the apparatus has been opened to permit production of well fluids up through the tubing string.

Turning now to FIGS. 2 and 3, a more detailed view is thereshown of the gravel packing and production control means 40, which is shown in its first position in FIG. 2 and in its second position in FIG. 3.

Control means 40 includes a cylindrical body 54 having a side wall with a plurality of gravel packing ports 56 disposed therethrough. The body 54 has an upper end 58, and a lower end 60 with a longitudinal passageway 62 defined therethrough. The longitudinal passageway 62 intersects and is in communication with the gravel packing ports 56 in the first position illustrated in FIG. 2.

The control means 40 also includes a valve means generally designated by the numeral 64 disposed in the body 54. The valve means 64 has a first position illustrated in FIG. 2 for initially blocking the longitudinal passageway 62 below the gravel packing ports 56 while the gravel packing ports 56 are communicated with the longitudinal passageway 62 to permit flow of gravel packing slurry down through the tubing string 34 and through the longitudinal passageway 62 out the gravel packing ports 56 into the lower well annulus 48.

The valve means 64 has a second position illustrated in FIG. 3 wherein the gravel packing ports 56 are isolated from the longitudinal passageway 62, and the longitudinal passageway 62 is open to permit production of well fluids from the subsurface formation 22 up through the longitudinal passageway 62 and up through the tubing string 34.

The valve means 64 includes a closure means 66 for initially blocking the longitudinal passageway 62. The closure means 66 is preferably a frangible ceramic disc which is located substantially immediately adjacent a lower extent of the gravel packing ports 56 to minimize any buildup of particulate material from the slurry on top of the disc 66.

The valve means 64 also includes a sliding sleeve 68 operably associated with the closure means 66, and movable between a first position as shown in FIG. 2 wherein the closure means 66 blocks the longitudinal passageway 62 and the gravel packing ports 56 are open, and a second position shown in FIG. 3 wherein the closure means 66 is open and the gravel packing ports 56 are closed.

In the embodiment of FIGS. 2 and 3, the sliding sleeve 68, when in its first position of FIG. 2, is located above the frangible disc 66. As the sleeve 68 moves from the first position of FIG. 2 to its second position of FIG. 3, it strikes the frangible disc 66 breaking the same up so that the fragments of disc 66 can fall downward and come to rest in the bull plug 46 as schematically illustrated in FIG. 1B where the fragments are indicated as 66A and 66B. The sliding sleeve 68 can be generally described as a sliding sleeve impacting means 68 for impacting and breaking open the frangible disc 66 as the sleeve 68 moves from its first position of FIG. 2 to its second position of FIG. 3.

It is noted that instead of using bull plug 46, the screen assembly could have a lower extension received in a seal bore of an open sump packer in place of sump packer 20. In that case, the fragments of disc 66 would fall through the open sump packer into the sump of the well.

The valve means 64 also includes a piston 70 defined on the sliding sleeve 68 and having first and second sides 72 and 74.

The body 54 has a bore 76 defined therein within which the piston 70 is slidably received. The body has a low pressure chamber 78 defined therein adjacent the first side 72 of piston 70, and has a high pressure chamber 80 defined therein adjacent the second side 74 of piston 70. The pressure in low pressure chamber 78 is preferably substantially atmospheric pressure which is trapped therein during assembly of the control means 40 at the surface.

The valve means 64 also includes an actuating means 82 for selectively communicating the high pressure chamber 80 with the longitudinal passageway 62 above the gravel packing ports 56. The actuating means 82 includes a communication port 84 extending through a wall of sleeve 68 to communicate the longitudinal passageway 62 with the high pressure chamber 80. Actuating means 82 also includes a frangible hollow tube 86, commonly referred to as a cobe, which initially blocks the communication port 84 and extends radially inward into the longitudinal passageway 62 as seen in FIG. 2.

The piston 70 carries a sliding seal 88 which seals against the bore 76. Upper and lower sliding seals 90 and 92 seal between the sleeve 68 and the body 54 to define upper and lower extremities of the high pressure chamber 80 and low pressure chamber 78, respectively.

To move the valve means 64 from its first position of FIG. 2 to its second position of FIG. 3, a bar 94 (see FIG. 2) is dropped down through the tubing string 34. The bar 94 impacts the frangible hollow tube 86 shearing the same away from sleeve 68 thus leaving the communication port 84 open to communicate the longitudinal passageway 62 with the high pressure chamber 80. Then fluid pressure from within longitudinal passageway 62 acts downward upon the second side 74 of piston 70 to rapidly move the sliding sleeve 68 downward against the frangible disc 66 to break up the same thus opening the longitudinal passageway 62 as indicated in FIG. 3.

The bar 94 will also impact the frangible disc 66 and aid in breaking up the frangible disc 66.

As previously noted the frangible disc 66 is preferably located immediately adjacent the lower edge or lower extremity of gravel packing ports 56 to minimize any buildup of sand or other particulate material on top of the disc 66. The purpose of this feature is to minimize the presence of any material on top of disc 66 which might interfere with or soften the impact of sleeve 68 against disc 66.

Although not illustrated in FIGS. 2 and 3, the sliding sleeve 68 can be initially shear pinned in place relative to body 54.

A lock ring 95 is carried in a groove 97 in sleeve 68 and springs out into engagement with a locking groove 99 defined internally on body 54 to lock the sleeve 68 in its second position of FIG. 3.

It will be appreciated that movement of sleeve 68 could be actuated in other ways as an alternative or as a backup to the system illustrated. For example, a heavy bar could be lowered on a slick line and dropped one or more times against a corresponding shoulder or surface of sleeve 68 to drive sleeve 68 downward.

The control means 40 also includes an overshot 96 which extends over the upper end 58 of body 54. Overshot 96 has a bore 98 which is closely received about an outer cylindrical surface 100 of body 54 with a plurality of O-ring seals 102 provided therebetween. Thus the overshot 96 sealingly engages the body 54.

The control means 40 also includes a releasable locking means generally designated by the numeral 104, for locking the overshot 96 to the body 54 while the valve means 64 is initially blocking the longitudinal passageway 62 as shown in FIG. 2, and for subsequently releasing the overshot 96 when the valve means 64 opens the longitudinal passageway 62 as shown in FIG. 3.

The releasable locking means 104 includes an annular groove 106 defined internally on body 54, the uppermost edge of the groove 106 defining a downward facing latching surface 108 within the body 54.

The releasable locking means 104 also includes a spring collet 110 attached to the overshot 96 and extending downward into the longitudinal passageway 62 of body 54. The collet 110 includes a plurality of spring fingers such as 112 and 114. Each of the spring fingers includes an enlarged radially outward extending head 116.

In the first position of FIG. 2, the valve means 64 has an upper portion of sleeve 68 closely received within the spring collet 110 to hold the enlarged heads 116 below the latching surface 108 so that the overshot 96 is positively latched to the body 54.

When the sliding sleeve 68 of valve means 64 moves to its second position of FIG. 3, the upper portion of sleeve 68 moves downward out of the spring collet 110 thus releasing the positive mechanical latch between overshot 96 and body 54. The overshot 96 will still remain in sealing engagement with the body 54 until such time as a sufficient upward force is applied to overshot 96 to cam the enlarged heads 116 of spring fingers 112 and 114 radially inward so that the overshot 96 can pass upward out of engagement with body 54. Typically the spring collet 110 will be constructed so as to require an upward pull of approximately 2,000 pounds to cam the spring fingers 112 and 114 inward and permit the overshot 96 to be disengaged from the body 54.

Figure 4A:
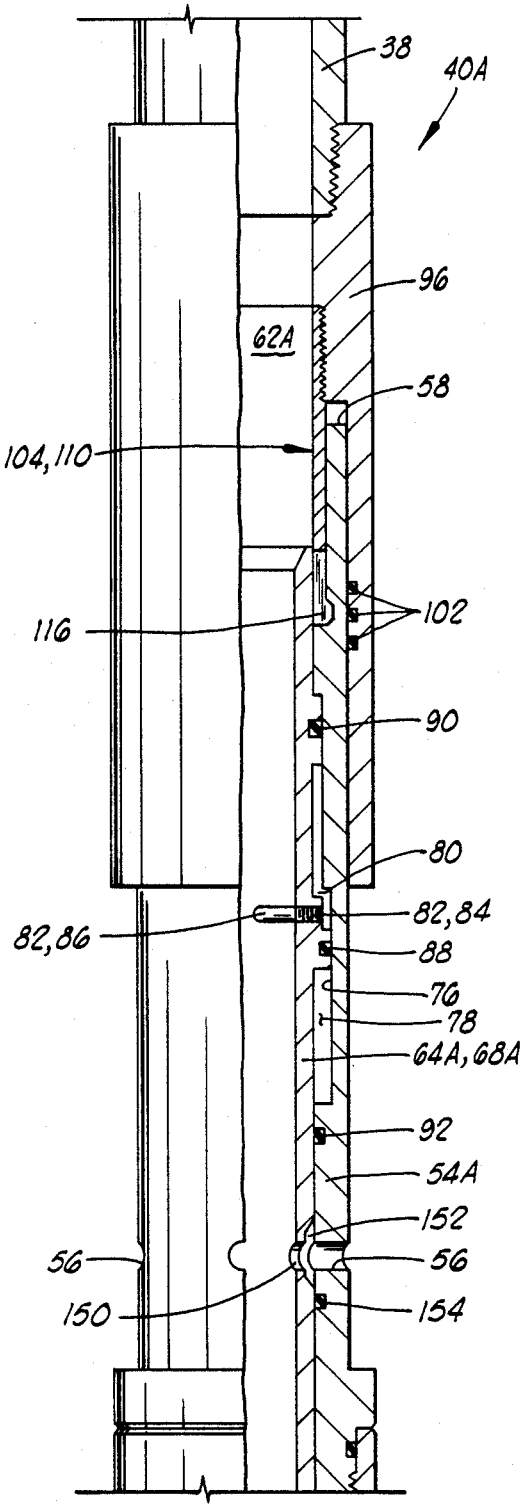
FIGS. 4A–4B comprise an elevation half section somewhat schematic view of an alternative embodiment of the gravel packing and production control means of FIG. 2, wherein the frangible disc has been replaced with a rotatable ball valve to initially close the longitudinal passageway below the gravel packing ports. The alternative apparatus of FIGS. 4A–4B is shown in its initial position corresponding functionally to the initial position of FIG. 2.
Figure 4B:
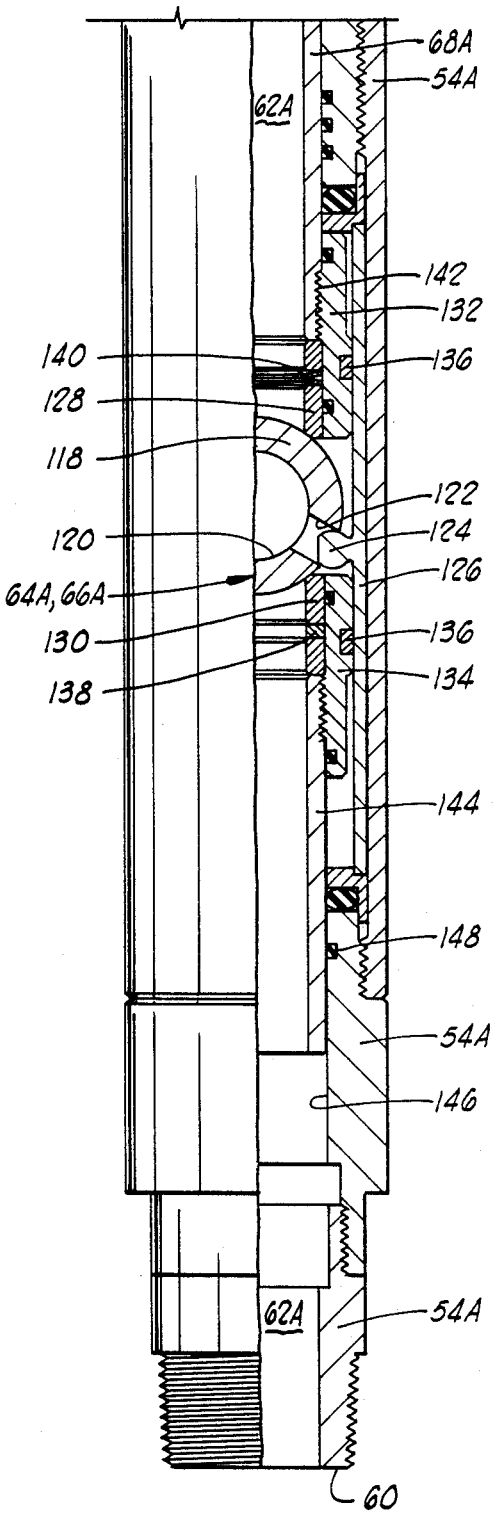

The Alternative Embodiment Of FIGS. 4A–4B

In FIGS. 4A–4B an alternative embodiment of the gravel packing and production control means is shown and generally designated by the numeral 40A. In the embodiment of FIGS. 4A–4B, components identical to those of the embodiment of FIGS. 2 and 3 are indicated by identical numerals, and analogous but modified components are indicated by the suffix "A".

The control means 40A has been modified primarily with regard to construction of the valve means 64A, and more particularly with regard to the closure means 66A which in the embodiment of FIG. 4B is a rotatable ball valve 66A.

The ball valve closure means 66A includes a spherical valve member 118 having a bore 120 therethrough. The spherical valve member 118 has an eccentric hole 122 therein within which is received an operating lug 124. The operating lug 124 is an integral part of a vertical bar 126 which is held in place relative to body 54A.

The spherical member 118 sealingly engages upper and lower seats 128 and 130.

Upper seat 128 is held in an upper seat holder 132, and lower seat 130 is held in a lower seat holder 134.

A plurality of C-clamps 136, only the ends of which are visible in FIG. 4B, span between and connect the upper and lower seat holders 132 and 134. An annular spacer 138 is sandwiched between lower seat 130 and lower seat holder 134. A pair of Belleville type biasing springs 140 are sandwiched between the upper seat 128 and upper seat holder 132 to provide a biasing force to keep the upper and lower seats 128 and 130 in close sealing engagement with the outer surface of spherical member 118.

The modified sliding sleeve 68A has its lower end attached to upper seat holder 132 at threaded connection 142.

A guide mandrel 144 is attached to lower seat holder 134 and has its lower end portion closely and slidably received within a bore 146 of a lower segment of body 54A with a sliding O-ring seal 148 provided therebetween.

The modified gravel packing and production control means 40A is shown in FIGS. 4A–4B in its initial position, with the gravel packing ports 56 open and communicated with the longitudinal passageway 62A through a plurality of ports 150 in sleeve 68A which communicate with a reduced diameter outer groove 152 which is in registry with gravel packing ports 56. In the initial position of FIGS. 4A–4B, the spherical valve member 118 of ball valve type closure means 66A is in a closed position as shown in FIG. 4B closing the longitudinal passageway 62A.

To move the alternative control means 40A to a second position corresponding functionally to the position of apparatus 40 shown in FIG. 3, a weight is dropped on a wireline to shear the hollow cylindrical tube 86 and permit fluid pressure to reach high pressure chamber 80 to drive the sliding sleeve 68A downward relative to body 54A by means of the pressure entering high pressure chamber 80.

An O-ring seal 154 is located below the gravel packing ports 56. When the groove 152 moves below O-ring 154, the gravel packing ports 56 are closed.

The downward movement of sliding sleeve 68A carries with it the upper and lower seat holders 132 and 134, with the spherical valve member 118 held in place therebetween and guided downward by the lower guide mandrel 144 which also moves therewith. The eccentric lug 124 remains stationary, and causes the spherical valve member 118 to rotate so that its bore 120 is aligned with longitudinal passageway 62A in the second position of the apparatus.

Manner Of Operation

The general methods for completing wells with the present invention can be described as follows. The following description is given with reference to the preferred embodiment of FIGS. 2 and 3, but it will be understood that it also applies to the alternative embodiment of FIGS. 4A–4B.

First a gravel packing assembly is made up on the tubing string 34. The gravel packing assembly includes the packer 36, slip joint 38, gravel packing and control means 40, blank pipe 42, screen 44 and bull plug 46.

The tubing string 34 and the gravel packing assembly is run into the well 10 until the screen 44 is located in the perforated zone 30 adjacent the subsurface formation 22.

At that point it is desirable to circulate fluid through the well to make certain that the well is full of fluid. Then, the packer 36 is set by mechanical manipulation thereof and the casing annulus above packer 36 is pressure tested.

Then gravel packing slurry, typically sand in a fluid carrier, is pumped down the tubing string 38 while circulating the fluid standing in the casing up through the well annulus. This is accomplished by unsetting the packer 36 so that fluid in the tubing string 34 can move down the tubing string 34 out the gravel packing ports 56, then up the annulus past packer 36 until the slurry is spotted at about the elevation of the packer 36. Then, the packer 36 is reset to isolate the perforated zone 30, and the slurry is pumped into the lower annulus 48 along with any desired pad fluid, and squeezed through the perforations 28 into the formation 22 as schematically illustrated in FIG. 1B. This operation continues until the gravel pack, i.e., the sand 156, builds up around the screen 44 along its entire length, so that the perforated zone 30 becomes a gravel packed zone. During the gravel packing operation there is no fluid flow of consequence in through the screen 44, since the longitudinal passageway 62 is blocked by closure means 66.

After the slurry injection is completed, the packer 36 is again unseated by mechanical manipulation and slurry remaining in the tubing string 38 is reverse circulated out by pumping down the well annulus past the packer 36, then into the gravel packing ports 56 and up the longitudinal passageway 62.

Then, the surface support equipment associated with the gravel packing operation at the ground surface is shut down and rigged down.

Subsequently, while maintaining the tubing string 34 in place in the well 10, the drop bar 94 is dropped to shear off the frangible hollow tube 86 thus causing the sliding sleeve 68 to move downward to its second position of FIG. 3 thus communicating the tubing string 34 with the interior 52 of screen 44 and isolating the tubing string 38 from any other communication with the gravel packed zone 156. Both the tubing 34 and casing 14 are standing full of fluid of sufficient weight to prevent flow of fluid out of formation 22.

Next, the blowout preventer equipment at the ground surface is dismantled and removed from the well, and a production tree or Christmas tree is connected to the upper end of the tubing 34 which now serves as production tubing 34. In order to accommodate the dimensions of the production Christmas tree, it will typically be necessary to raise the tubing string 34 a distance on the order of perhaps ten feet. This movement is accommodated by the slip joint 38 which permits sufficient travel of the tubing string 34 to allow for connection of this surface production equipment.

Also, if desired, the Christmas tree can be installed prior to dropping bar 94 to open the well for production.

If the slip joint 38 is not present in the tool string, the overshot 96 will be pulled off the body 54 to allow installation of the surface production equipment. The overshot can be lowered back into place over body 54 by adding appropriate pipe into the tubing string 34. If slip joint 38 is not present it is necessary to drop bar 94 prior to installing the surface production equipment.

In either event, after the surface production equipment is installed, and with the tubing string 34 still maintained in place in the well 10, well fluid from the subsurface formation 22 is produced through the gravel packed zone 30 and through the screen 44, then up from the interior 52 of screen 44 through the tubing string 34 to the surface.

The gravel packing assembly can be described as having an upper portion and a lower portion connected by the releasable connecting means 104. The releasable connecting means 104 releasably locks the tubing string 34 and an upper portion of the gravel packing assembly including the packer 36 to the lower portion of the gravel packing assembly which includes the screen 44. As previously described, the releasable locking means 104 is unlocked when the sleeve 68 moves downward as shown in FIG. 3. The overshot 96 nevertheless remains in sealing engagement with the body 54.

If at some subsequent time it is necessary to remove the tubing string 34 from the well, this can be accomplished by pulling up on tubing string 34 with sufficient force, e.g., 2,000 pounds, to pull the collet 110 out of engagement with body 54.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of the invention may be made by those skilled in the art, which changes are encompassed within the scope and spirit of the present invention as defined by the appended claims.

What is claimed is:

1. An apparatus for gravel packing a well and opening the well to production, comprising:

a cylindrical body having a side wall with a gravel packing port disposed through said side wall, said body having an upper end and a lower end, and having a longitudinal passageway defined therethrough from said upper end to said lower end, said longitudinal passageway intersecting said gravel packing port;

valve means, disposed in said body, for initially blocking said longitudinal passageway below said gravel packing port while said gravel packing port is communicated with said longitudinal passageway to permit flow of gravel packing slurry from said longitudinal passageway out said gravel packing port, and for subsequently isolating said gravel packing port from said longitudinal passageway and opening said longitudinal passageway to permit production of fluids from said well up through said longitudinal passageway, said valve means including:

closure means for initially blocking said longitudinal passageway;

a sliding sleeve operably associated with said closure means, and movable between a first position wherein said closure means blocks said longitudinal passageway and said gravel packing port is open, and a second position wherein said closure means is open and said gravel packing port is closed; and a piston defined on said sliding sleeve, said piston having first and second sides;

wherein said body has a bore defined therein in which said piston is slidably received, and said body has a low pressure chamber defined therein adjacent said first side of said piston and a high pressure chamber defined therein adjacent said second side of said piston; and wherein said valve means further includes actuating means for selectively communicating said high pressure chamber with said longitudinal passageway above said gravel packing port, said actuating means including a communication port extending through a wall of said sleeve to communicate said longitudinal passageway with said high pressure chamber and a frangible hollow tube which initially blocks said communication port and extends radially inward into said longitudinal passageway.

2. The apparatus of claim 1 wherein a pressure in mold for pressure chamber is substantially atmospheric pressure when said apparatus is in place at a depth in said well at which the wall is to be gravel packed.

3. An apparatus for gravel packing a well and opening the well to production, comprising:

a cylindrical body having a side wall with a gravel packing port disposed through said side wall, said body having an upper end and a lower end, and having a longitudinal passageway defined therethrough from said upper end to said lower end, said longitudinal passageway intersecting said gravel packing port;

valve means, disposed in said body, for initially blocking said longitudinal passageway below said gravel packing port while said gravel packing port is communicated with said longitudinal passageway to permit flow of gravel packing slurry from said longitudinal passageway out said gravel packing port, and for subsequently isolating said gravel packing port from said longitudinal passageway and opening said longitudinal passageway to permit production of fluids from said well up through said longitudinal passageway;

an overshot extending over said upper end of said body and sealingly engaging said body; and releasable locking means for locking said overshot to said body while said valve means is initially blocking said longitudinal passageway and for subsequently releasing said overshot when said valve means opens and longitudinal passageway, said releasable locking means including:

a downward facing latching surface defined within said body;

a spring collet attached to said overshot and extending downward into said longitudinal passageway of said body, said collet including a plurality of spring fingers with enlarged radially outward extending heads; and said valve mans having a sleeve initially closely received within said spring collet to hold said enlarged heads of said spring collet below said latching surface of said body.

4. A well completion assembly constructed to be run on a tubing string into a well having a well bore, comprising:

a packer means for sealing between the tubing string and the well bore to define a lower well annulus below said packer means;

a screen located below said packer means, said screen having an exterior and an interior; and a gravel packing and production control means, located between said packer means and said screen, for initially permitting flow of gravel packing slurry down the tubing string and into the lower well annulus around said exterior of said screen, and for subsequently permitting production of well fluids through said screen into said interior thereof and up through the tubing string without tripping the tubing string out of the well, said gravel packing and production control means including:

a cylindrical body having a side wall with a gravel packing port disposed through said side wall, said body having an upper end and a lower end, and having a longitudinal passageway defined therethrough from said upper end to said lower end, said longitudinal passageway intersecting said gravel packing port; and valve means, disposed in said body, for initially blocking said longitudinal passageway below said gravel packing port while said gravel packing port is communicated with said longitudinal passageway to permit flow of gravel packing slurry from said longitudinal passageway out said gravel packing port, and for subsequently isolating said gravel packing port from said longitudinal passageway and opening said longitudinal passageway to permit production of fluids from said well up through said longitudinal passageway, said valve means including frangible disc closure means for initially blocking said longitudinal passageway, and a sliding sleeve operably associated with said closure means and movable between a first position wherein said closure means blocks said longitudinal passageway and said gravel packing port is open and a second position wherein said closure means is open and said gravel packing port is closed, said sliding sleeve being located above said frangible disc closure means when said sleeve is in its said first position, and said sleeve being further characterized as an impacting means for impacting and breaking open said frangible disc closure means as said sleeve moves from its said first position to its said second position.

5. The well completion assembly of claim 4, further comprising:

a slip joint means, located above said gravel packing and production control means, for permitting sufficient movement of the tubing string after said lower well annulus is gravel packed to allow for connection of surface production equipment to the tubing string.

6. A well completion assembly constructed to be run on a tubing string into a well having a well bore, comprising:

a packer means for sealing between the tubing string and the well bore to define a lower well annulus below said packer means;

a screen located below said packer means, said screen having an exterior and an interior; and a gravel packing and production control means, located between said packer means and said screen, for initially permitting flow of gravel packing slurry down the tubing string and into the lower well annulus around said exterior of said screen, and for subsequently permitting production of well fluids through said screen into said interior thereof and up through the tubing string without tripping the tubing string out of the well, said gravel packing and production control means including:

a cylindrical body having a side wall with a gravel packing port disposed through said side wall, said body having an upper end and a lower end, and having a longitudinal passageway defined therethrough from said upper end to said lower end, said longitudinal passageway intersecting said gravel packing port; and valve means, disposed in said body, for initially blocking said longitudinal passageway below said gravel packing port while said gravel packing port is communicated with said longitudinal passageway to permit flow of gravel packing slurry from said longitudinal passageway out said gravel packing port, and for subsequently isolating said gravel packing port from said longitudinal passageway and opening said longitudinal passageway to permit production of fluids from said well up through said longitudinal passageway, said valve means including closure means for initially blocking said longitudinal passageway, and a sliding sleeve operably associated with said closure means, and movable between a first position wherein said closure means blocks said longitudinal passageway and said gravel packing port is open, and a second position wherein said closure means is open and said gravel packing port is closed;

wherein said valve means includes a piston defined on said sliding sleeve, said piston having first and second sides;

wherein said body has a bore defined therein in which said piston is slidably received, and said body has a low pressure chamber defined therein adjacent said first side of said piston and a high pressure chamber defined therein adjacent said second side of said piston; and wherein said valve means further includes actuating means for selectively communicating said high pressure chamber with said longitudinal passageway above said gravel packing port.

7. The well completion assembly of claim 6, further comprising:

a slip joint means, located above said gravel packing and production control means, for permitting sufficient movement of the tubing string after said lower well annulus is gravel packed to allow for connection of surface production equipment to the tubing string.

8. A well completion assembly constructed to be run on a tubing string into a well having a well bore, comprising:

a packer means for sealing between the tubing string and the well bore to define a lower well annulus below said packer means;

a screen located below said packer means, said screen having an exterior and an interior; and a gravel packing and production control means, located between said packer means and said screen, for initially permitting flow of gravel packing slurry down the tubing string and into the lower well annulus around said exterior of said screen, and for subsequently permitting production of well fluids through said screen into said interior thereof and up through the tubing string without tripping the tubing string out of the well, said gravel packing and production control means including:

a cylindrical body having a side wall with a gravel packing port disposed through said side wall, said body having an upper end and a lower end, and having a longitudinal passageway defined therethrough from said upper end to said lower end, said longitudinal passageway intersecting said gravel packing port; and valve means, disposed in said body, for initially blocking said longitudinal passageway below said gravel packing port while said gravel packing port is communicated with said longitudinal passageway to permit flow of gravel packing slurry from said longitudinal passageway out said gravel packing port, and for subsequently isolating said gravel packing port from said longitudinal passageway and opening said longitudinal passageway to permit production of fluids from said well up through said longitudinal passageway;

an overshot extending over said upper end of said body and sealingly engaging said body; and releasable locking means for locking said overshot to said body while said valve means is initially blocking said longitudinal passageway and for subsequently releasing said overshot when said valve means opens said longitudinal passageway, and releasable locking means including:

a downward facing latching surface defined within said body;

a spring collet attached to said overshot and extending downward into said longitudinal passageway of said body, said collet including a plurality of spring fingers with enlarged radially outward extending heads; and said valve means having a sleeve initially closely received within said spring collet to hold said enlarged heads of said spring collet below said latching surface of said body.

9. An apparatus for gravel packing a well and opening the well to production, comprising:

a cylindrical body having a side wall with a gravel packing port disposed through said side wall, said body having an upper end and a lower end, and having a longitudinal passageway defined therethrough from said upper end to said lower end, said longitudinal passageway intersecting said gravel packing port;

valve means, disposed in said body, for initially blocking said longitudinal passageway below said gravel packing port while said gravel packing port is communicated with said longitudinal passageway to permit flow of gravel packing slurry from said longitudinal passageway out said gravel packing port, and for subsequently isolating said gravel packing port from said longitudinal passageway and opening said longitudinal passageway to permit production of fluids from said well up through said longitudinal passageway;

an overshot extending over said upper end of said body and sealingly engaging said body; and releasable locking means for locking said overshot to said body while said valve means is initially blocking said longitudinal passageway and for subsequently releasing said overshot simultaneously as said valve means opens said longitudinal passageway.

10. A method of completing a well having a perforated zone adjacent a subsurface formation from which well fluids are produced, comprising:

(a) making up a tubing string and a gravel packing assembly including a packer and a screen having a screen interior and releasably locking said tubing string and an upper portion of said gravel packing assembly including said packer to a lower portion of said gravel packing assembly including said screen;

(b) running said tubing string and said gravel packing assembly into the well until said screen is located in the perforated zone adjacent the subsurface formation;

(c) setting said packer to isolate the perforated zone;

(d) injecting slurry down through said tubing string and into the perforated zone of the well around said screen and packing the slurry into the perforated zone, so that the perforated zone becomes a gravel packed zone surrounding said screen;

(e) while maintaining said tubing string in place in the well, communicating said tubing string with said interior of said screen;

(f) simultaneously with said step (e), unlocking said upper portion of said gravel packing assembly from said lower portion while maintaining said upper and lower portions in sealing engagement, to permit subsequent removal of said tubing string and packer from the well if necessary; and (g) while still maintaining said tubing string in place in the well, producing well fluids from the subsurface formation through said gravel packed zone and through said screen and then from said interior of said screen up through said tubing string.

11. The method of claim 10, wherein:

said step (a) is further characterized in that said gravel packing assembly includes a slip joint located above said screen; and said method further includes a step, after said step (d), of accommodating with said slip joint sufficient travel of said tubing string above said slip joint to allow for connection of surface production equipment to said tubing string.

12. The method of claim 10, wherein:

said step (d) is further characterized as squeeze packing the slurry into the perforated zone.

13. The method of claim 10, wherein:

said step (e) further includes a step, simultaneous with said communicating step, of isolating said tubing string from any other communication with said gravel packed zone.

* * * * *